US007784402B2

(12) United States Patent
Cummings et al.

(10) Patent No.: US 7,784,402 B2
(45) Date of Patent: Aug. 31, 2010

(54) METHOD FOR LOADING PRINTING PLATE ON IMAGING DEVICE

(75) Inventors: Calvin D. Cummings, Surrey (CA); Peter Hawes, Burnaby (CA)

(73) Assignee: Eastman Kodak Company, Rochester, NY (US)

( * ) Notice: Subject to any disclaimer, the term of this patent is extended or adjusted under 35 U.S.C. 154(b) by 640 days.

(21) Appl. No.: 11/739,152

(22) Filed: Apr. 24, 2007

(65) Prior Publication Data

US 2008/0264287 A1 Oct. 30, 2008

(51) Int. Cl.
*B41F 21/00* (2006.01)

(52) U.S. Cl. ..... 101/415.1; 101/382.1; 101/486; 101/DIG. 36

(58) Field of Classification Search ..... 101/378, 101/382.1, 383, 409, 415.1, 477, 485, DIG. 36
See application file for complete search history.

(56) References Cited

U.S. PATENT DOCUMENTS 4,876,456 A 10/1989 Isono et al.
4,881,086 A 11/1989 Misawa
5,992,325 A 11/1999 Schumann et al.
6,189,452 B1 2/2001 Halup et al.
6,260,482 B1 7/2001 Halup et al.
6,318,262 B1 11/2001 Wolber et al.
6,604,465 B2 8/2003 Tice et al.
6,722,280 B2 * 4/2004 Shih ..... 101/483
6,736,396 B2 * 5/2004 Fukui ..... 271/275
6,742,455 B2 * 6/2004 Fukui ..... 101/477
6,815,702 B2 11/2004 Kiermeier et al.
7,124,686 B2 * 10/2006 Behrens et al. ..... 101/389.1

FOREIGN PATENT DOCUMENTS

EP 1 081 458 3/2001

* cited by examiner

*Primary Examiner*—Ren Yan
(74) *Attorney, Agent, or Firm*—Nelson Adrian Biish

(57) ABSTRACT

A method for aligning the leading edge of printing plate (110) to an axially disposed slot (70) in a cylindrical surface (30) of an imaging drum (20) comprising at least one printing plate clamp (90) having a clamp surface (100) disposed parallel to the slot, the method comprising straightening (210) the leading edge against the clamp surface and positioning (220) the leading edge to protrude over the slot by rotating the imaging drum under the plate. The straightening comprises resting (200) the leading edge of the plate on the cylindrical surface of the imaging drum and rotating the imaging drum about its cylindrical axis (60) to contact with the clamp surface a point along the leading edge of the plate and to rotate the plate until its leading edge is in alignment with the clamp surface.

7 Claims, 11 Drawing Sheets

METHOD FOR LOADING PRINTING PLATE ON IMAGING DEVICE

CROSS REFERENCE TO RELATED APPLICATIONS

Reference is made to commonly-assigned, copending U.S. patent application Ser. No. 11/204,223, filed Aug. 16, 2005, entitled PRINTING PLATE REGISTRATION AND IMAGING, by Neufeld et al., and U.S. patent application Ser. No. 11/693,007, filed Mar. 29, 2007, entitled PRINTING PLATE REGISTRATION USING A CAMERA, by Cummings et al., the disclosures of which are incorporated herein.

FIELD OF THE INVENTION

The invention relates to printing and, in particular to providing registered images on printing plates.

BACKGROUND OF THE INVENTION

Printing plates may be imaged on a plate-making machine and then transferred to a printing press. Once on the printing press, the images from the printing plates are transferred to paper or other suitable substrates. It is important that images printed using a printing press be properly aligned with the substrate on which they are printed. Obtaining such alignment typically involves:

- carefully aligning a reference edge of a printing plate with pins or other features on the plate making machine;
- detecting one reference point on an orthogonal edge of the printing plate (i.e. orthogonal to the reference edge) at a known distance from the reference pins;
- imaging the printing plate; and
- using the reference edge and the orthogonal edge reference point to align the printing plate on a drum of the printing press.

One common technique of aligning the printing plate on the drum of a printing press involves using the reference edge and the orthogonal edge reference point to align the printing plate on a punching machine and punching registration holes in the printing plate. The printing plate may then be aligned on the drum of the printing press with registration pins that project through the registration holes.

Traditionally mechanical alignment pins have been used to align the plate to be imaged to the drum of a platesetter. This is not a flexible arrangement. The pins have to be mounted in predetermined positions. There are also reliability challenges in consistently and accurately loading the plate into contact with the pins. It is also difficult to define sets of pins that allow a wide range of plate formats to be imaged whilst not interfering with one another.

There is therefore a need for an alignment mechanism not based on mechanical locating pins. A number of these have been proposed. Examples are disclosed in and in U.S. Pat. No. 6,318,262 (Wolber et al.) in both of which edge detection sensors are employed in the load path to an imaging drum upon which a printing plate is imaged. U.S. Pat. No. 4,881,086 (Misawa) also describes a laser recorder with sheet edge detection based on the principle of the difference in reflectivity between that of the sheet and that of the drum on which it is carried. EP 1 081 458 A2 (Elior et al.) teaches the use of an apparatus to determine a skew angle of the plate mounted on a plate support surface. U.S. Pat. No. 4,876,456 (Isono et al.) describes using photosensors having light emitting elements and light receiving elements disposed in a path for carrying a photosensitive film. EP 1 081 458 A2 describes an apparatus for detecting a plate edge using a light beam and detector.

In U.S. Pat. No. 6,815,702 (Kiermeier et al.) a method and apparatus are disclosed to locate an edge of an imageable plate mounted on a drum or other support surface. A light source and light sensor are used to measure the difference in reflectivity between the plate and the support surface. The drum or support surface contains at least one groove to increase the difference in reflectivity between the plate and the support surface. The groove may also contain an anti-reflecting layer to further increase the difference in reflectivity. The groove may also have a geometric shape that causes incident light to be directed away from the light sensor. U.S. Pat. No. 6,815,702 describes that, with the groove parallel to the drum axis, an edge of the plate is "generally perpendicular to the groove" when the plate is "properly mounted." It also explains that the groove cannot be parallel to and positioned under the edge of the plate, as this makes precise detection of the plate "unreliable, and near impossible" by the method of the patent.

A further important aspect of the entire plate alignment process is the method of loading of the plate onto the imaging drum. While there is some description in the prior art of systems for correcting the placement of a plate on a drum, it is generally more effective to get the plate loaded as close to perfectly aligned as possible during the initial loading step. In the case of the method described in U.S. patent application Ser. No. 11/693,007, the fully loaded printing plate needs to be protruding over the slot and aligned as closely as possible with the edge of the slot.

U.S. Pat. No. 6,604,465 (Tice et al.) describes the loading of a printing plate onto an external drum while rotating the drum in a first direction. No mention is made of rotating the drum in another direction while loading the plate. While the patent does disclose a method for aligning of the printing plate without requiring any holes to be punched in the printing plate, alignment of the printing plate is in fact done using pins on the drum. The printing plate is then imaged while the drum is rotated in the first, or in a second, opposite direction. Finally, the printing plate is unloaded from the drum while rotating the drum in the second direction.

U.S. Pat. Nos. 6,260,482 and 6,189,452 (both to Halup et al.) respectively describe a method and apparatus for loading and unloading plates to external drum devices based on movable clamps. The system is characterized by clamps, ideally in pairs of which the members are circumferentially disposed with respect to each other, that are movable over the surface, preferably along circumferential tracks, enabling the attachment of multiple plates, end-to-end and/or side-by-side. To mount a printing plate on the drum, a first clamp of each relevant pair is first opened and then engaged to the leading edge of the printing plate, which is fed from a suitably positioned loading mechanism, and then releasing the clamps to grip the leading edge of the printing plate. The drum is then rotated in a first direction to pull the plate and wrap it around the drum. Then the other clamp of each pair is opened and the drum is rotated in a second opposite direction, while the clamp remains stationary, until the trailing edge of the plate is engaged by the clamp, whereupon the clamp is released, thus gripping the trailing edge by slidable clamps. After normal imaging operation, the plate is demounted in the same general order, by first releasing the first clamp of each pair (which grips the leading edge of the plate) and moving it away from the plate in the second direction of the drum, thus freeing that edge, then rotating the drum in the first direction, thus pushing the plate onto a suitably position unloading bin, and finally releasing the second clamp of the pair, thus freeing the plate.

No mention is made of moving the drum in different directions in order to correctly position the plate on the drum.

U.S. Pat. No. 5,992,325 (Schumann et al.) describes a method for automatically detecting the trailing edge of a printing plate. The detecting can be the determination within a trailing edge clamp of either the location of the edge, or the determination of the presence of the trailing edge. To this end, a sensor is employed. This patent also discloses a method for loading the printing plate. The method starts, after release of the trailing edge of a previous plate, with the ejection of the previous printing plate, which is achieved by rotating the drum in a first direction to push the plate by its leading edge. The leading edge of that plate is then unclamped. The drum is then rotated in a second, opposite direction by a very small amount, enough to clear the leading edge of the previous plate. The drum is then rotated in the first direction again to receive the leading edge of a new plate into the same clamp from which the leading edge of the earlier plate has been ejected. The presence and or location of this leading edge is determined by the sensor. The printing plate is then clamped by its leading edge. The next step comprises rotating the drum in the second direction in order to wrap the printing plate on the drum. Suitable steps are taken to tauten the printing plate on the drum and to secure the trailing edge. While the patent describes small rotations of the drum to load and release the printing plate, it does not address the matter of alignment of the printing plate or its exact positioning relative to any possible slot in the drum.

In commonly-assigned U.S. patent application Ser. No. 11/204,223 an edge detection system is described, based on using a digital camera to image the edges of a printing plate perpendicular to the sub-scan direction. Based on the information so obtained, the image data is then adjusted to compensate for any misalignment between the plate and the drum on which it is loaded. In commonly-assigned U.S. patent application Ser. No. 11/693,007 an edge detection system is described, based on using a digital camera to image the leading edge of a printing plate. The system employs a slot in the cylindrical surface of an imaging drum, the slot having a radially recessed surface that has diffusely reflective surfaces and substantially non-reflective surfaces. The system allows the leading edge of a printing plate protruding over the slot to be located through the leading edge clamps by illumination with a suitable illumination source and imaging with a digital camera.

Commonly-assigned U.S. patent application Ser. No. 11/693,007, incorporated herein in full, requires a newly loaded printing plate to be protruding over the slot and aligned as closely as possible with the edge of the slot in the drum described in that patent application. The prior art does not describe how this is to be achieved.

SUMMARY OF THE INVENTION

The present invention constitutes a method for aligning a leading edge of one or more printing plates to a cylindrical axis of an imaging drum, the imaging drum comprising at least one leading edge printing plate clamp having a clamp surface disposed parallel to the cylindrical axis. The method comprises resting the leading edge on a cylindrical surface of the imaging drum and rotating the imaging drum in a reverse direction about a cylindrical axis to contact with the clamp surface a point along the leading edge and rotate the at least one printing plate until the leading edge is in alignment with the clamp surface.

In a further aspect, the invention constitutes a method for aligning a leading edge of one or more printing plates to an axially disposed slot in a cylindrical surface of an imaging drum, the imaging drum comprising at least one leading edge printing plate clamp having a clamp surface disposed parallel to the slot. The method comprises straightening the leading edge against the clamp surface by rotating the imaging drum in a reverse direction about its cylindrical axis and then rotating the imaging drum about its cylindrical axis in a forward direction until the leading edge protrudes over the slot by a predetermined amount. The straightening comprises resting the leading edge of the printing plate on the cylindrical surface of the imaging drum and rotating the imaging drum in a reverse direction about its cylindrical axis to contact with the clamp surface a point along the leading edge of the at least one printing plate and to rotate the printing plate until its leading edge is in alignment with the clamp surface.

In a further aspect the invention constitutes a method for determining an alignment of at least one printing plate relative to an imaging drum on which the at least one plate is mounted, the method comprising aligning to an axially disposed slot in a cylindrical surface of the imaging drum a leading edge of the at least one printing plate, determining a location of at least one point on the leading edge of the at least one printing plate; and determining the alignment of the printing plate at least in part from the location of at least a part of the leading edge in a digital camera image of the at least one point, and from a position of the digital camera, used for obtaining the digital image, relative to the imaging drum during the capturing of the at least one digital camera image of the at least one point.

BRIEF DESCRIPTION OF THE DRAWINGS

In the drawings which illustrate non-limiting embodiments of the invention.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
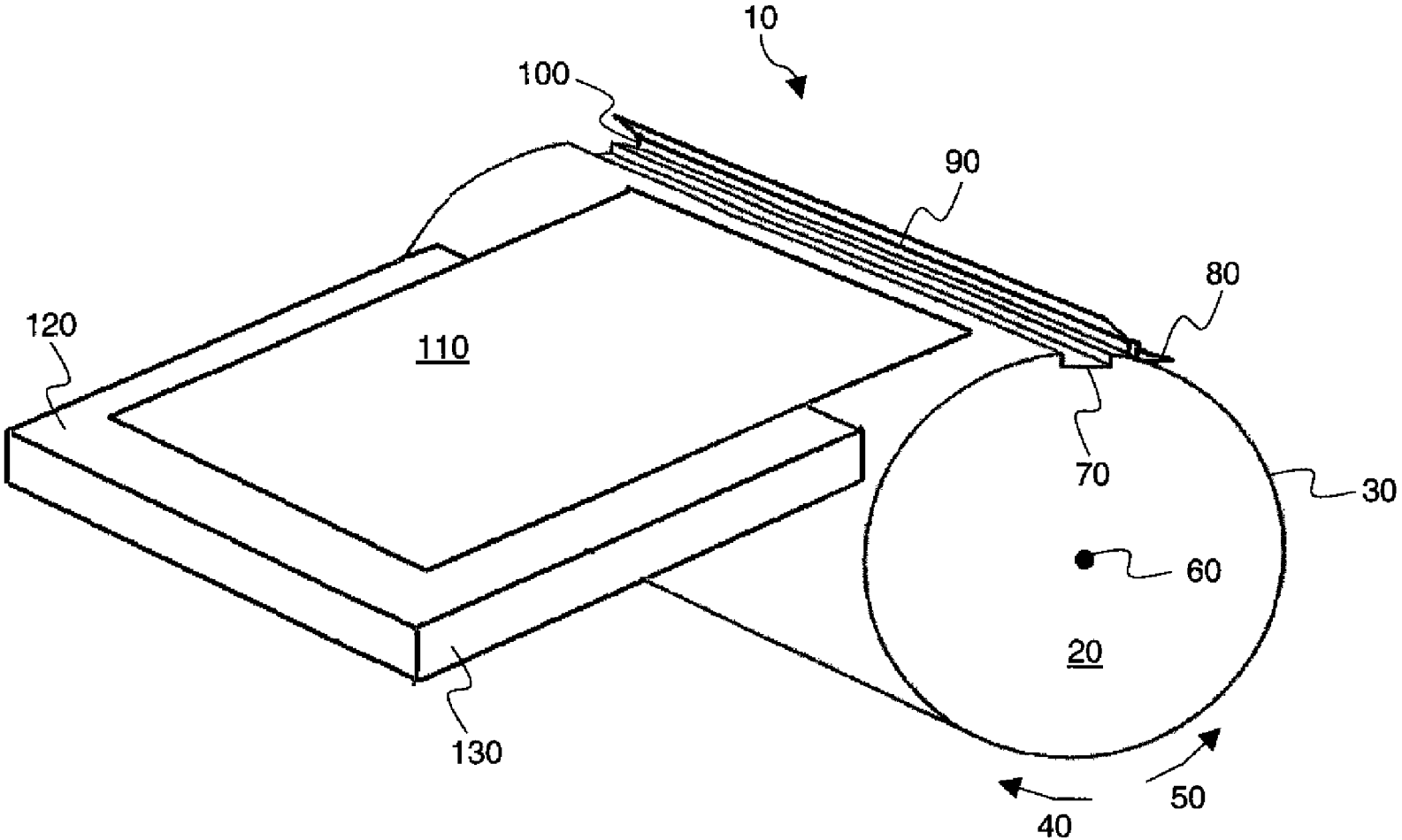
FIG. 1 is a schematic diagram of an external drum-type plate-making machine.

FIG. 1 is a schematic depiction of a plate-making machine 10 of the present invention comprising an imaging drum 20 having cylindrical surface 30. Imaging drum 20 is rotatable both in forward direction 40 and in reverse direction 50, about cylindrical axis 60. Imaging drum 20 comprises a slot 70 extending in an axial direction along cylindrical surface 30 of imaging drum 20. The slot can be of the type described in commonly assigned and co-pending U.S. patent application Ser. No. 11/693,007. Imaging drum 20 comprises trailing edge printing plate clamp 80 for clamping a trailing edge of a printing plate to cylindrical surface 30. Trailing edge printing plate clamp 80 may comprise a plurality of individual printing plate clamps arranged in line with one another on cylindrical surface 30 in an axial direction with respect to imaging cylinder 20. Imaging drum 20 further comprises leading edge printing plate clamp 90 for clamping a leading edge of a printing plate to cylindrical surface 30. Leading edge printing plate clamp 80 may comprise a plurality of individual printing plate clamps arranged in line with one another on cylindrical surface 30 in an axial direction with respect to imaging cylinder 20. Leading edge printing plate clamp 90 comprises a clamp surface 100. Clamp surface 100 may be any surface or part of leading edge printing plate clamp, including a one-dimensional line on leading edge printing plate clamp 90, as long as the requirement is met of clamp surface 100 lying in a plane intersecting cylindrical surface 30 along a line that is parallel to cylindrical axis 60. Loading table 130 has loading surface 120 on which may be placed a printing plate 110 for loading onto imaging drum 20. Loading table 130 is disposed proximate cylindrical surface 30, and is arranged to allow a leading edge of plate 110 to rest on cylindrical surface 30 of imaging drum 20 while the bulk of printing plate 110 remains on loading surface 120 of loading table 130. For the sake of clarity, the imaging subsystem, drive systems and controllers of plate-making machine 10 are not shown in FIG. 1, as the invention pertains to the loading of printing plates.

Figure 2:
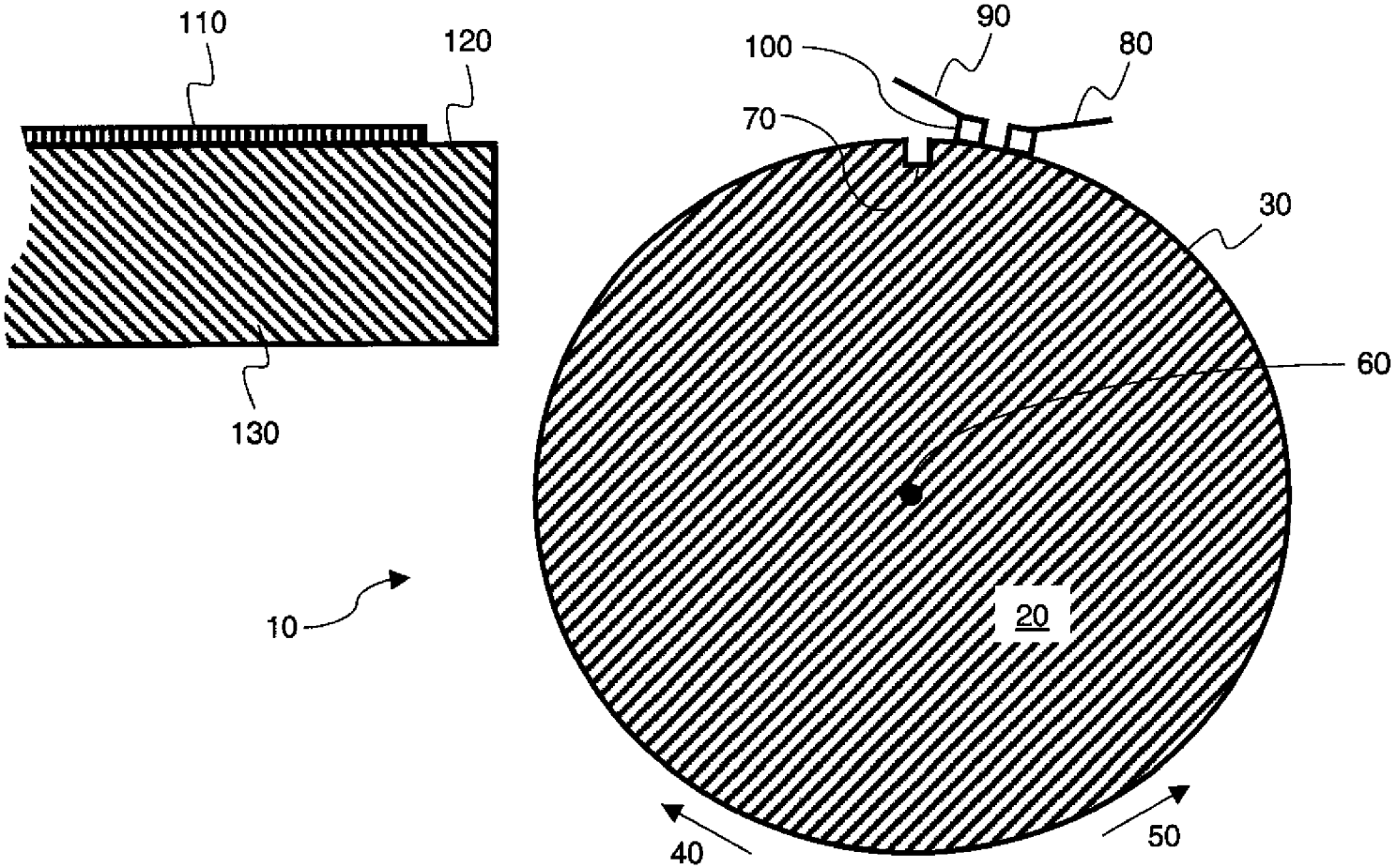
FIG. 2 is a cross-section of the plate-making machine of FIG. 1 showing a printing plate positioned on a loading table.

The method of the present invention will now be described at the hand of FIG. 1 and FIGS. 2 to 9, which show the steps of loading a printing plate onto the imaging drum of a plate-making machine. In FIG. 2 un-imaged printing plate 110 is shown positioned on loading surface 120 of loading table 130 before the method of the present invention is initiated. In an alternative embodiment of the present invention, printing plate 110 may be located elsewhere.

Figure 3:
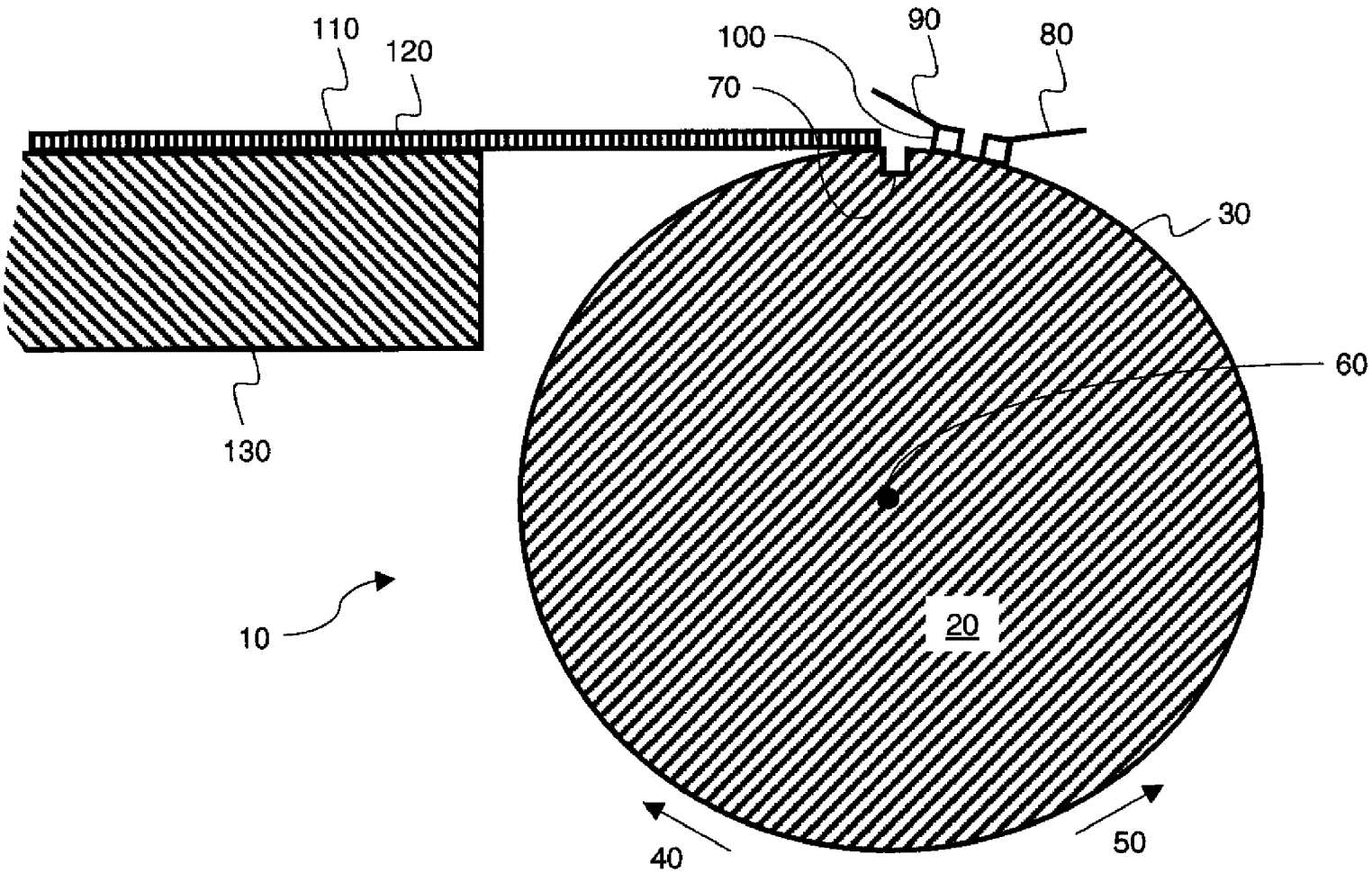
FIG. 3 is a cross-section of the plate-making machine of FIG. 1, showing a printing plate rested on the cylindrical surface of the drum of the plate-making machine.
Figure 10:
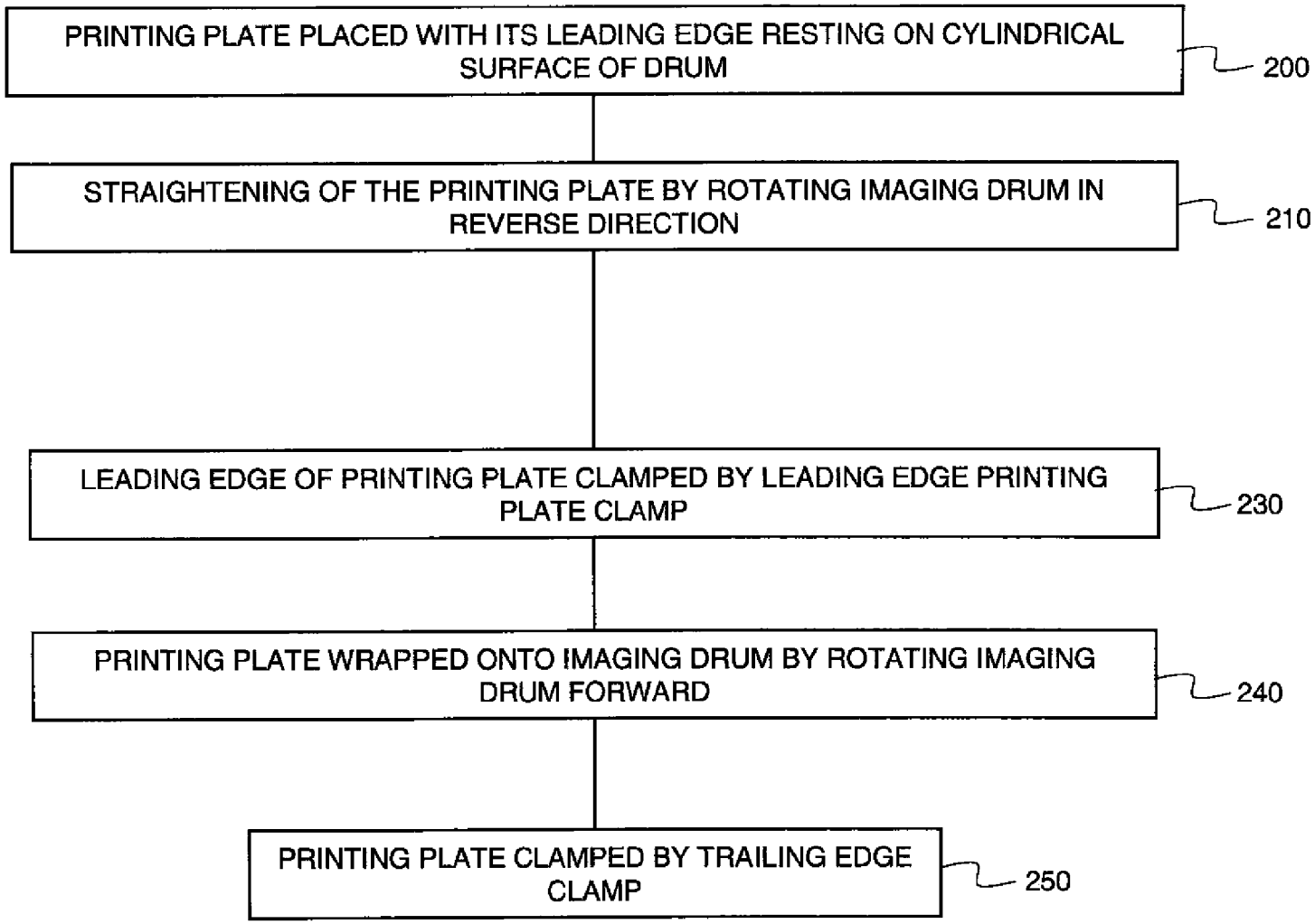
FIG. 10 is a flow diagram of a first embodiment of the present invention as shown in FIGS. 1-4 and 6-9.
Figure 11:
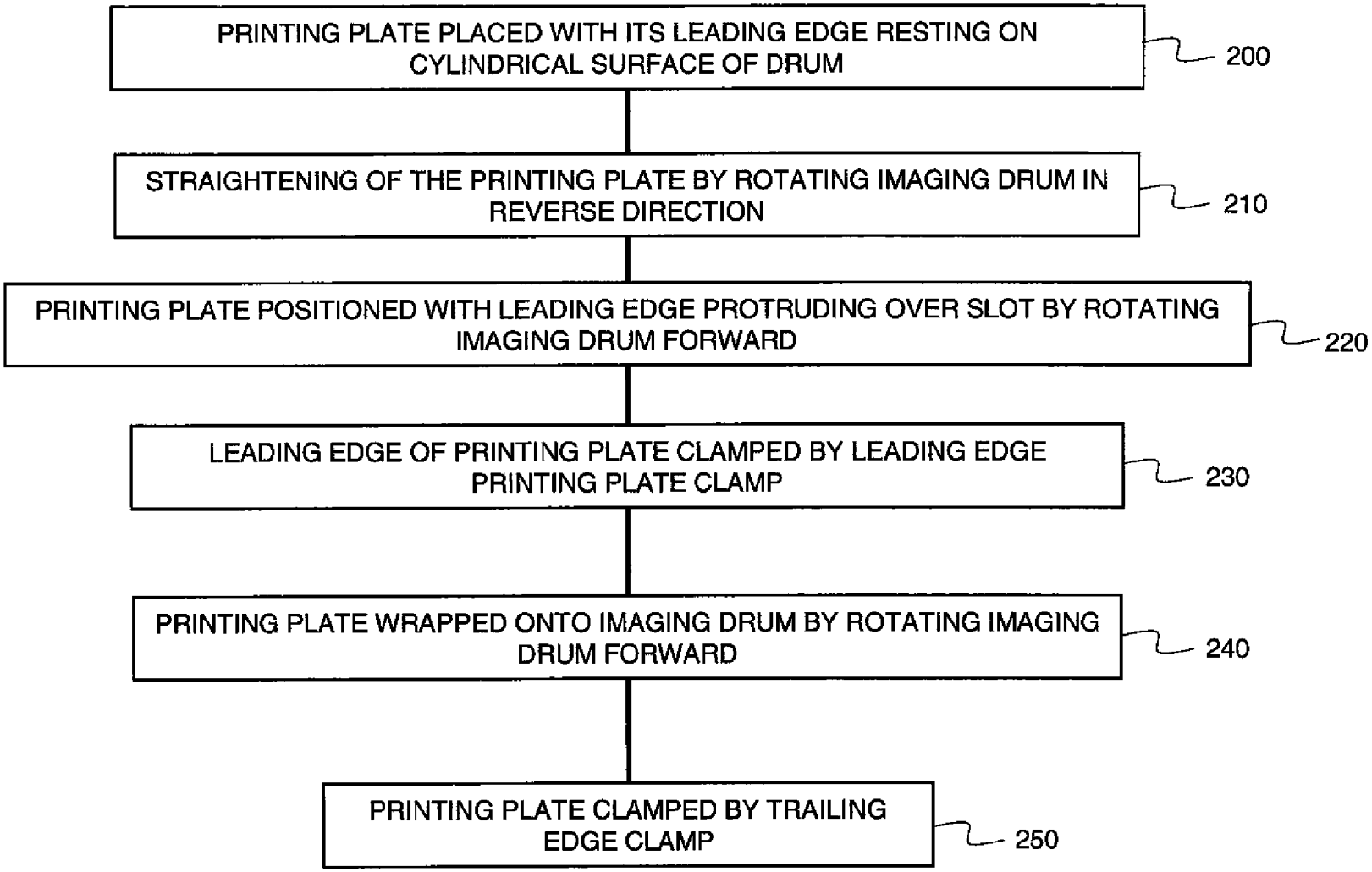
FIG. 11 is a flow diagram of a second embodiment of the present invention as shown in FIGS. 1-9.

As a first step 200 (see FIG. 10 and FIG. 11) of the present invention, shown in FIG. 3, printing plate 110 is placed with its leading edge (a) resting on cylindrical surface 30 and (b) substantially parallel to slot 70. To the extent that printing plate 110 can be very large and difficult to handle, the placement of printing plate 110 will typically not be such that the leading edge of printing plate 110 is perfectly parallel to slot 70. The bulk of printing plate 110 remains on loading surface 120 of loading table 130. This allows imaging drum 20 to rotate and thereby slide its cylindrical surface 30 under the leading edge of printing plate 110. The friction so created between cylindrical surface 30 and printing plate 110 is not enough to reposition printing plate 110.

Figure 4:
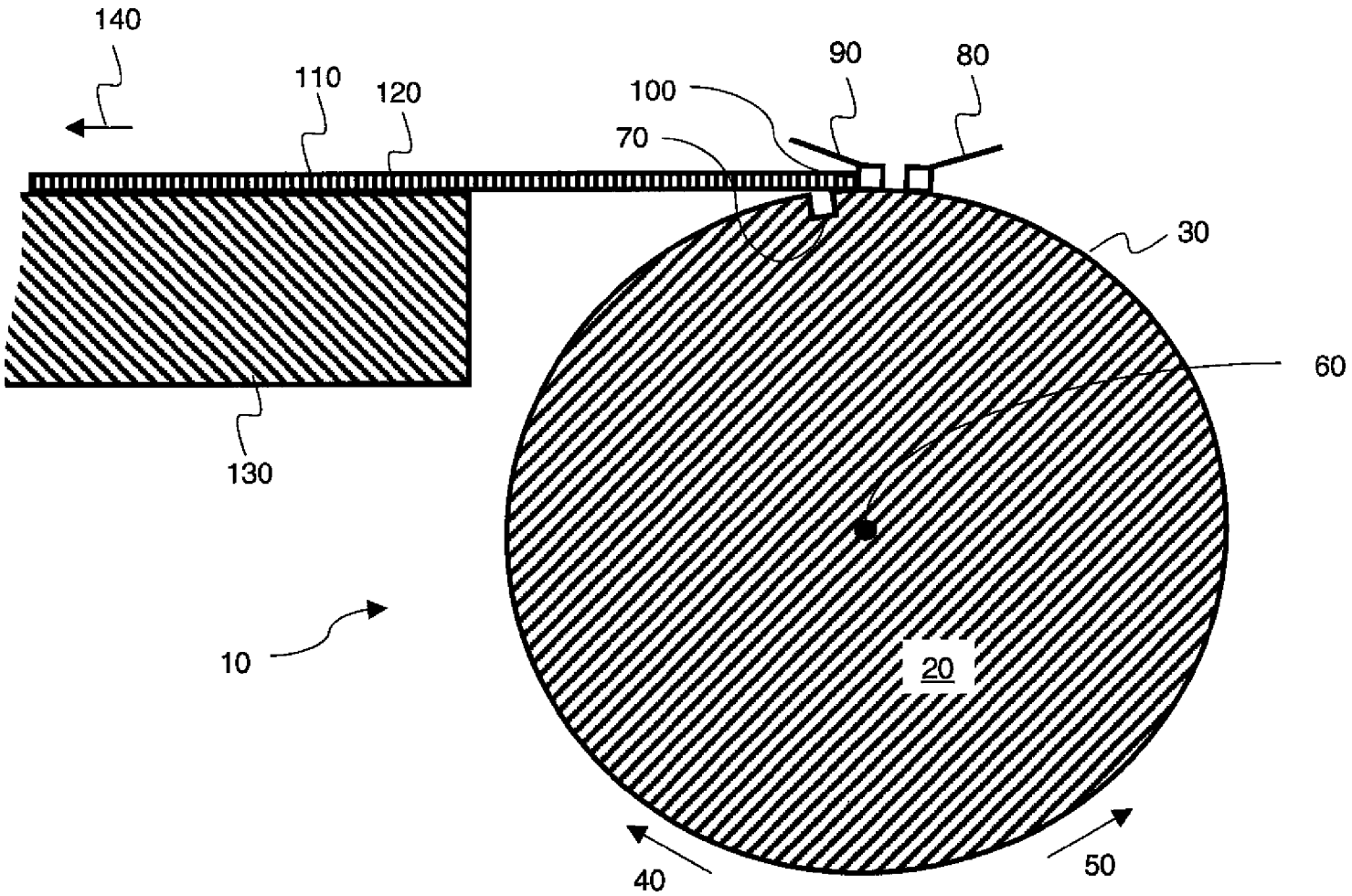
FIG. 4 is a cross-section of the plate-making machine of FIG. 1, showing a printing plate being straightened by rotation of the imaging drum of the plate-making machine in the reverse direction.

In a next step 210 (see FIG. 10 and FIG. 11), shown in FIG. 4, imaging drum 20 is rotated slowly in direction 50, also referred to herein as the "reverse direction." As a result of this rotation, clamp surface 100 engages with at least one point along the leading edge of printing plate 110 and, to the degree that the leading edge of printing plate 110 is not parallel to clamp surface 100, printing plate 110 is rotated by the advancing clamp surface 100 until the leading edge of printing plate 110 is aligned to clamp surface 100 and thereby to slot 70. Since the placement of printing plate 110 in FIG. 1 is already roughly aligned to slot 70, not much rotation is required to align printing plate 110 once the first point along its leading edge has made contact with clamp surface 100. At the end of this step, the leading edge of printing plate 110 is substantially aligned with axis 60 of imaging drum 20. In the present invention the term "straightening" of the printing plate is used to describe the rotation and alignment that printing plate 110 undergoes when subjected to this step of the invention. To the degree that any misalignment still remains, it may be addressed by the image rotation method described in commonly-assigned and co-pending U.S. patent application Ser. No. 11/693,007. In a first embodiment of the present invention, the next step comprises closing.

Figure 5:
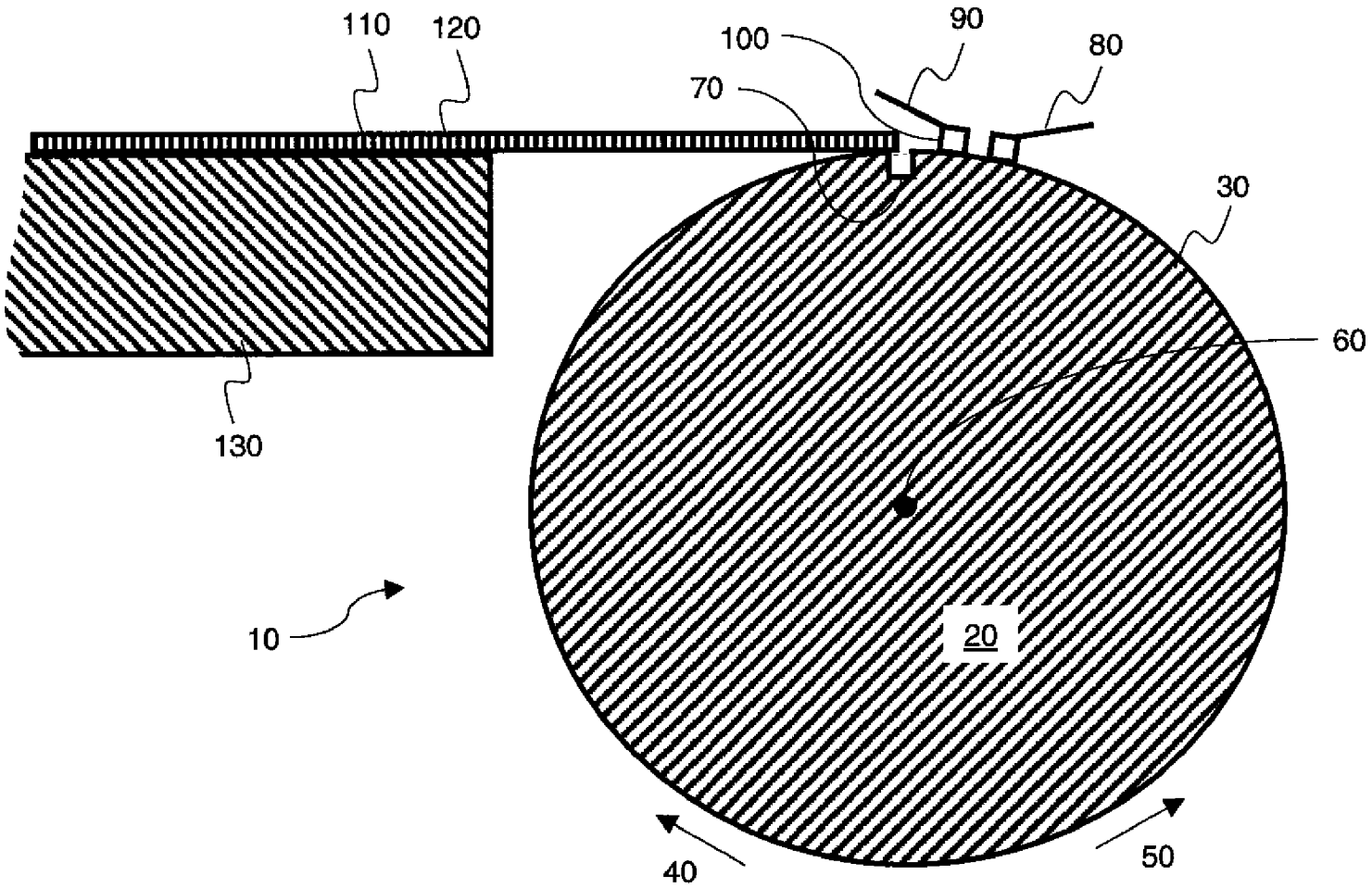
FIG. 5 is a cross-section of the plate-making machine of FIG. 1, showing a printing plate being positioned so that its leading edge protrudes over a slot in the cylindrical surface of the imaging drum of the plate-making machine.

In a further embodiment of the present invention an additional next step 220 (see FIG. 11), shown in FIG. 5, imaging drum 20 is rotated a predetermined distance in direction 40, also referred to herein as the "forward direction," thereby to cause cylindrical surface to slide under printing plate 110 until the leading edge of printing plate 110 protrudes a predetermined distance over the edge of slot 70 nearest to loading table 130. In one embodiment of the present invention, the leading edge of printing plate 110 is positioned in this way to protrude a distance greater than zero but less than the width of slot 70 over the edge of slot 70 nearest loading table 130. Preferably, the leading edge of printing plate 110 is positioned to protrude a distance greater than zero but less than half the width of slot 70 over the edge of slot 70 nearest loading table 130.

Figure 6:
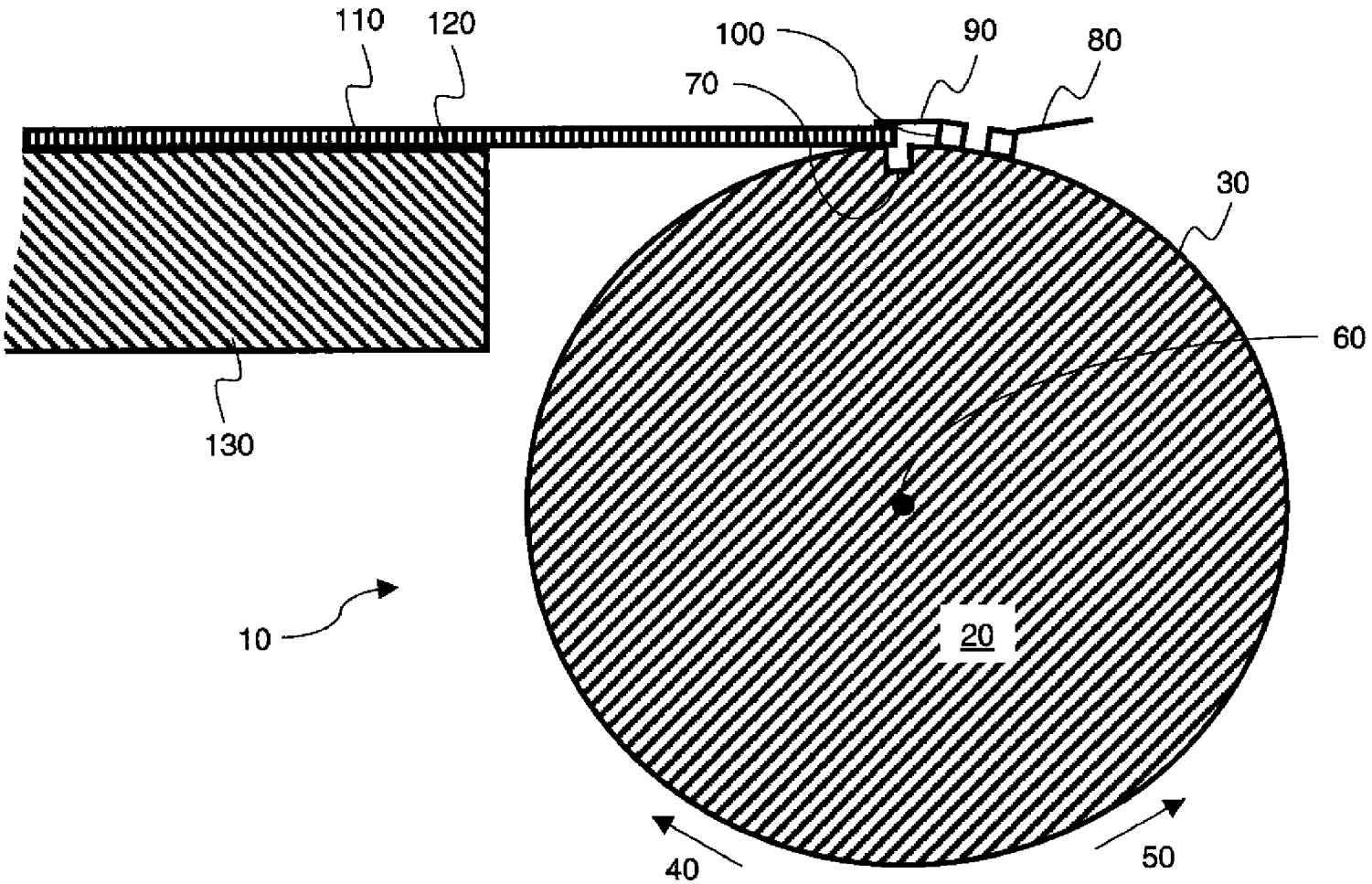
FIG. 6 is a cross-section of the plate-making machine of FIG. 1, showing a leading edge of a printing plate being clamped in position to the cylindrical surface of the imaging drum of the plate-making machine of FIG. 1 by a leading edge printing plate clamp.

The next step 230 (see FIG. 10 and FIG. 11) in the method of the present invention, holds for all embodiments and is that of closing leading edge printing plate clamp 90 so as to hold the leading edge of printing plate 110 to cylindrical surface 30. This is shown in FIG. 6.

Figure 7:
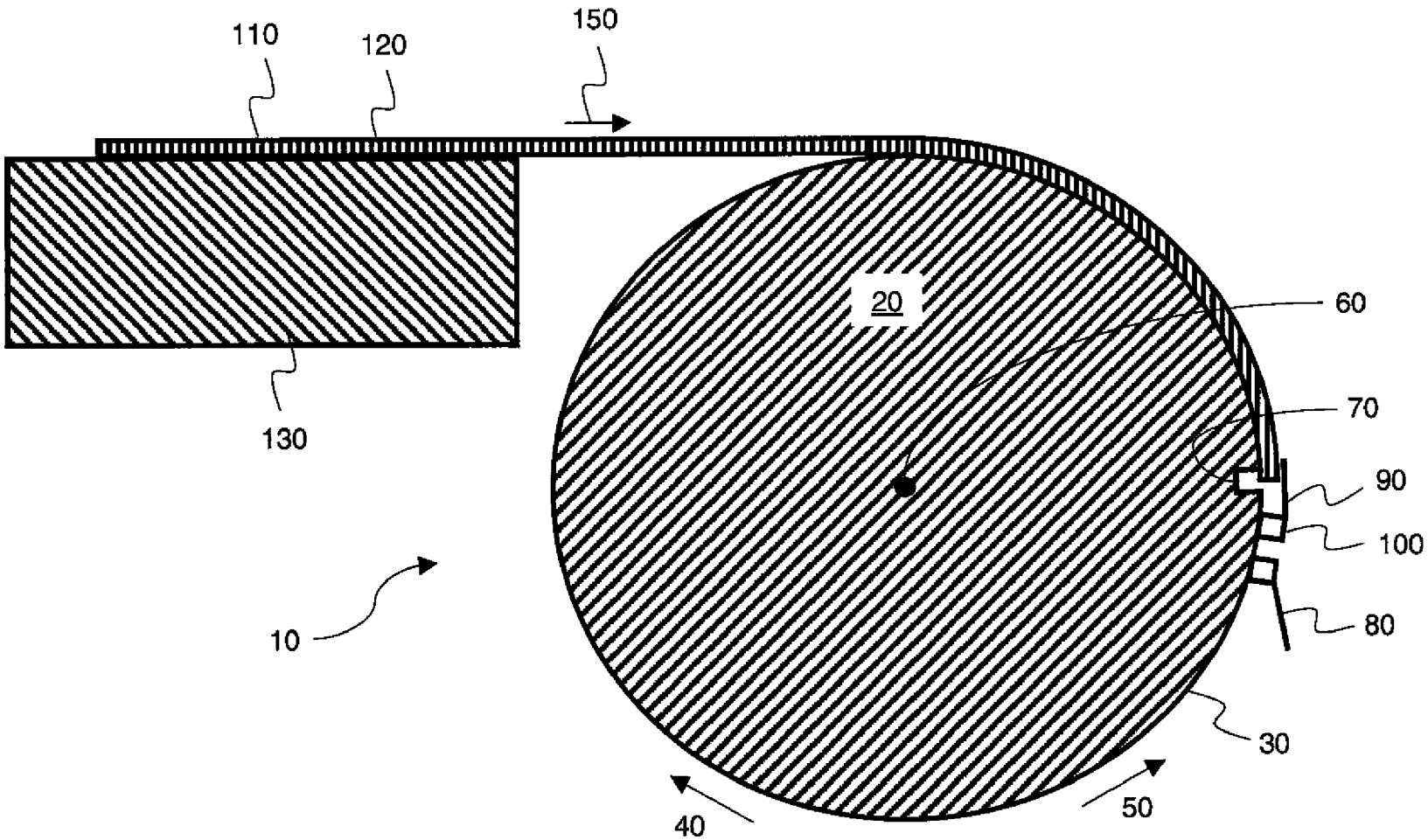
FIG. 7 is a cross-section of the plate-making machine of FIG. 1, showing a printing plate being wrapped onto the cylindrical surface of the imaging drum of the plate-making machine.

The next step 240 in both embodiments of the present invention (see FIG. 10 and FIG. 11) comprises rotating imaging drum 20 in the forward direction in order to wrap printing plate 110 onto cylindrical surface 30. FIG. 7 shows this process some distance through the step.

Figure 8:
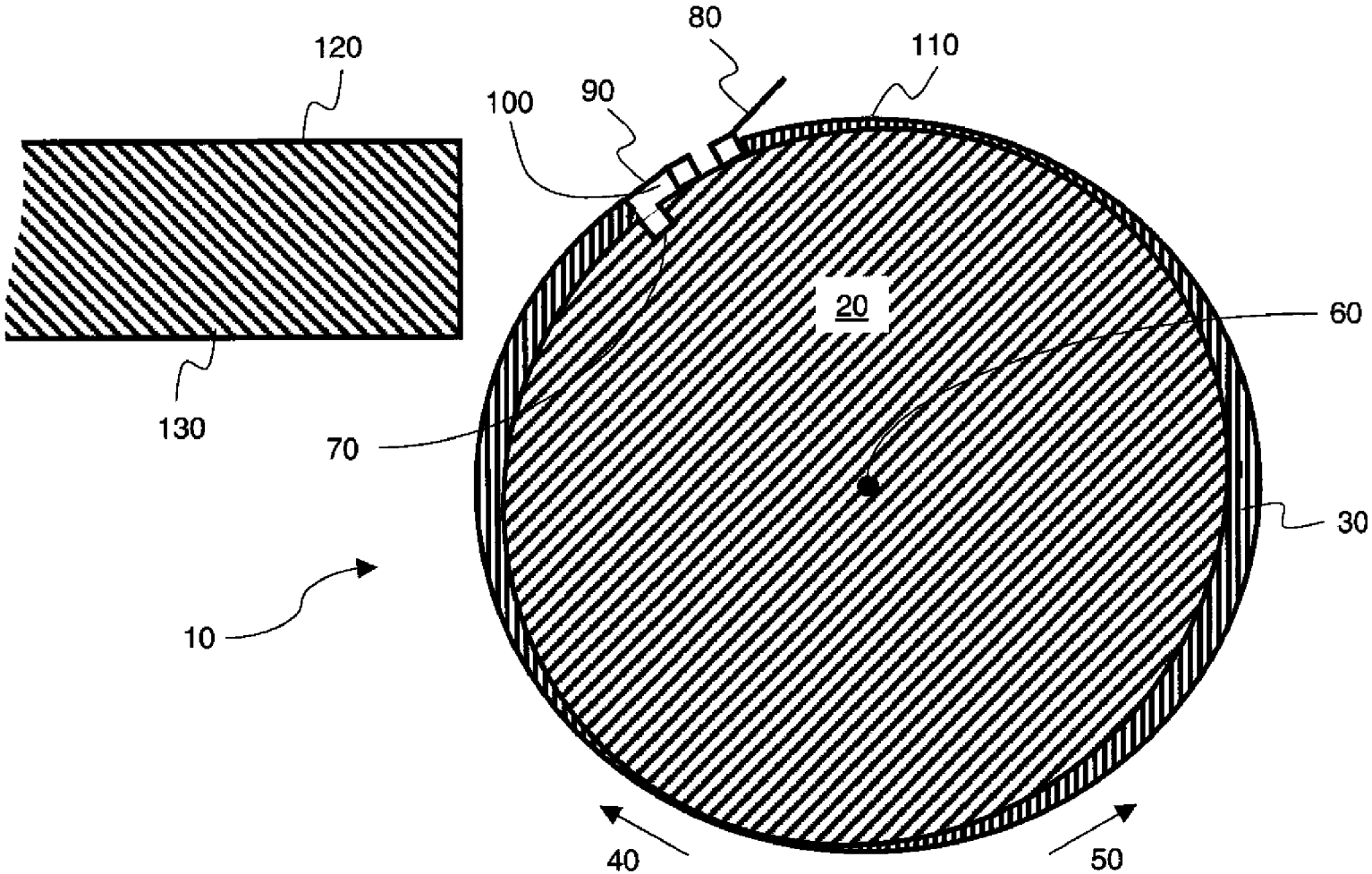
FIG. 8 is a cross-section of the plate-making machine of FIG. 1, showing a printing plate fully wrapped onto the cylindrical surface of the imaging drum of the plate-making machine.
Figure 9:
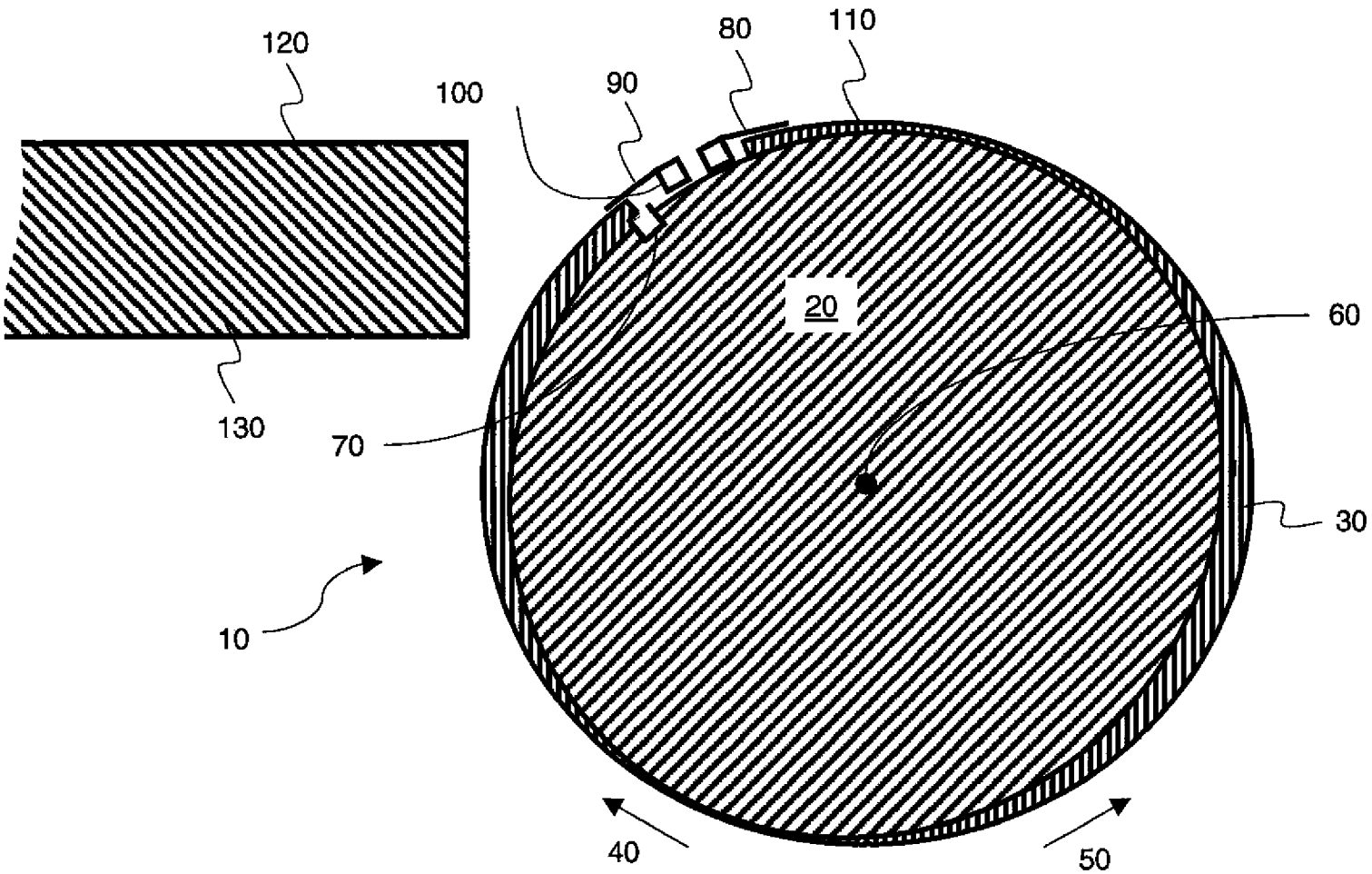
FIG. 9 is a cross-section of the plate-making machine of FIG. 1, showing a printing plate being clamped in position to the cylindrical surface of the imaging drum of the plate-making machine of FIG. 1 by a trailing edge printing plate clamp.

When the whole of printing plate 110 has been wrapped onto cylindrical surface 30, as in FIG. 8 (in both embodiments of the present invention), then, as a next step 250 (see FIG. 10 and FIG. 11), trailing edge printing plate clamp is closed, as shown in FIG. 9, to hold printing plate 110 to cylindrical surface 30. Printing plate 110 can also, either as alternative to trailing edge clamp 80 or in addition to trailing edge clamp 80, be held to cylindrical surface 30 by means of a vacuum that is applied through orifices in imaging drum 110. Techniques of applying a vacuum to an imaging drum of a plate-making machine are well-known in the art and will not be discussed here.

To the degree that the leading edge of printing plate 110 may not be perfectly aligned to the edge of slot 70 after the application of the above steps, the image rotation method of commonly-assigned and copending U.S. patent application Ser. No. 11/693,007 can be used to detect and locate the leading edge of printing plate 110. As described in more detail in commonly-assigned and copending U.S. patent application Ser. No. 11/693,007, a location of at least one point on the leading edge of printing plate 110 is then determined. The resulting alignment of printing plate 110 can then be determined, at least in part, from the location of the at least one point in at least one digital image of the leading edge, taken with a digital camera, together with the known position of the digital camera relative to the imaging drum during the capturing of the digital camera image of the at least one point. Preferably, two points along the leading edge of printing plate 110 are determined in this fashion, and used to determine the alignment by the method of commonly-assigned and copending U.S. patent application Ser. No. 11/693,007. Based upon that information, the image may be rotated to compensate for such remaining misalignment, using the image rotation method described in commonly-assigned and copending U.S. patent application Ser. No. 11/693,007. The printing plate is then imaged.

The method of the present invention is simple, trouble free, and inexpensive, as it uses components that are necessarily already incorporated in typical imaging drums, like leading edge clamps and trailing edge clamps. It also avoids the loading problems typical of many prior art plate-making machines, in which plates need to rotate and register against pins in the drum. Such prior art systems and techniques require high loading force which can cause the plates to buckle and give imaging errors. This is particularly true of so-called very large format (VLF) printing plates, which are heavy and cumbersome. Given their large size, damage to such plates is often an expensive proposition and is best avoided.

The invention has been described in detail with particular reference to certain preferred embodiments thereof, but it will be understood that variations and modifications can be effected within the scope of the invention.

PARTS LIST

10 plate-making machine (platesetter)
20 imaging drum
30 cylindrical surface
40 forward direction of rotation
50 reverse direction of rotation
60 cylindrical axis
70 slot
80 trailing edge printing plate clamp
90 leading edge printing plate clamp
100 clamp surface
110 printing plate
120 loading surface
130 loading table
200 printing plate placed with its leading edge resting on cylindrical surface of drum
210 straightening of the printing plate by rotating imaging drum in reverse direction
220 printing plate positioned with leading edge protruding over slot by rotating imaging drum forward
230 leading edge of printing plate clamped by leading edge printing plate clamp
240 printing plate wrapped onto imaging drum by rotating imaging drum forward
250 printing plate clamped by trailing edge clamp

The invention claimed is:

1. A method for aligning a leading edge of at least one printing plate to a cylindrical axis of an imaging drum, the imaging drum comprising at least one printing plate clamp, the at least one printing plate clamp comprising a clamp surface disposed parallel to the cylindrical axis; the method comprising:

a) resting the leading edge on a cylindrical surface of the imaging drum; and b) rotating the imaging drum in a first direction about the cylindrical axis to:

i) contact the leading edge with the clamp surface at one or more points along the leading edge; and ii) rotate the at least one printing plate until the leading edge is in alignment with the clamp surface.

2. A method as in claim 1, wherein the first direction is opposite to a direction that the imaging drum is rotated to wind the at least one printing plate onto a cylindrical surface of the imaging drum.

3. A method as in claim 1, wherein the resting comprises placing the at least one printing plate on a loading surface proximate the imaging drum.

4. A method as in claim 1, comprising rotating the imaging drum in a second direction opposite to the first direction after the leading edge is in alignment with the clamp surface.

5. A method as in claim 4, comprising closing the at least one printing plate clamp to hold the printing plate to the cylindrical surface after rotating the imaging drum in the second direction.

6. A method as in claim 1, comprising rotating the imaging drum in a second direction opposite to the first direction to create a gap between the leading edge and the clamp surface after rotating the imaging drum in the first direction.

7. A method as in claim 6, comprising clamping the leading edge.

* * * * *